United States Patent [19]

Ikeda et al.

[11] Patent Number: 4,535,760

[45] Date of Patent: Aug. 20, 1985

[54] VIBRATORY MASSAGE APPARATUS

[75] Inventors: Shigayuki Ikeda; Takafumi Hamabe, both of Hikone, Japan

[73] Assignee: Matsushita Electric Works, Ltd., Osaka, Japan

[21] Appl. No.: 461,999

[22] Filed: Jan. 28, 1983

[30] Foreign Application Priority Data

Feb. 16, 1982 [JP] Japan ..... 57-24197

[51] Int. Cl.[3] ..... A61H 1/00

[52] U.S. Cl. ..... 128/33; 128/36; 318/120; 318/130

[58] Field of Search ..... 128/32, 33, 41; 318/114, 120, 130, 127, 128

[56] References Cited

U.S. PATENT DOCUMENTS

| | | | |
|---|---|---|---|
| 2,323,081 | 6/1943 | Baird | 318/128 |
| 3,009,460 | 11/1961 | Leach | 128/33 |
| 4,105,024 | 8/1978 | Raffel | 128/33 |
| 4,232,661 | 11/1980 | Christensen | 128/33 |
| 4,370,602 | 1/1983 | Jones, Jr. et al. | 318/114 |

FOREIGN PATENT DOCUMENTS

| | | | |
|---|---|---|---|
| 3123976 | 1/1983 | Fed. Rep. of Germany | 128/24.5 |
| 1221089 | 2/1971 | United Kingdom | 128/33 |
| 2070433 | 9/1981 | United Kingdom | 128/33 |

*Primary Examiner*—Richard J. Apley
*Assistant Examiner*—David J. Brown
*Attorney, Agent, or Firm*—Burns, Doane, Swecker & Mathis

[57] ABSTRACT

A vibratory massage apparatus comprises a treatment portion elastically carried on a support, a vibration generator including an electric motor for providing vibrations to the treatment portion, and a control circuit connected to the motor for causing vibratory amplitude of the motor to be varied, whereby a variety of vibratory stimulation can be imparted to the user's affected part placed on the treatment portion of the apparatus with an excellent massaging effect.

1 Claim, 18 Drawing Figures

VIBRATORY MASSAGE APPARATUS

This invention relates generally to vibratory massage apparatuses and, more specifically, to an apparatus in which the user's affected part is brought into contact with a treatment portion vibrated by a vibration generator and a massaging vibration is imparted to the affected part.

In this type of the vibratory massage apparatus, there has been a problem that, so long as the amplitude of vibration transmitted from the vibration generator to the treatment portion is always constant, the user gets accustomed to the vibratory stimulation of the treatment portion so that the massaging effect will be practically lowered when the treatment is continued for a longer time. Therefore, there has been so far desired a vibratory massage apparatus which can effectively perform the massaging to the user over a long time of use, causing no habituation of the user to the vibratory stimulation.

A primary object of the present invention is, therefore, to provide a vibratory massage apparatus in which a vibration generator causes a treatment portion of the apparatus to be vibrated with variable amplitude to prevent the user from getting accustomed to the vibratory stimulation, whereby the massaging effect can be enhanced over a long time of use and thus a sufficient treatment can be provided to the user's affected part.

Another object of the present invention is to provide a vibratory massage apparatus which is capable of selectively providing massaging vibration of a "strong" or "weak" amplitude by means of a control circuit for the vibration generator, so that the user's affected part can be treated with a suitable intensity of vibration without causing the user to get accustomed to the vibratory stimulation.

A further object of the present invention is to provide a vibratory massage apparatus which can cyclically automatically vary the amplitude of vibration of the vibration generator by means of a control circuit to continuously give cyclically varying vibratory stimulation to the user's affected part, whereby a sufficient treatment of the affected part can be realized.

Other objects and advantages of the present invention shall become clear from following descriptions of certain preferred embodiments of the invention detailed with reference to accompanying drawings, in which.

Figure 6:
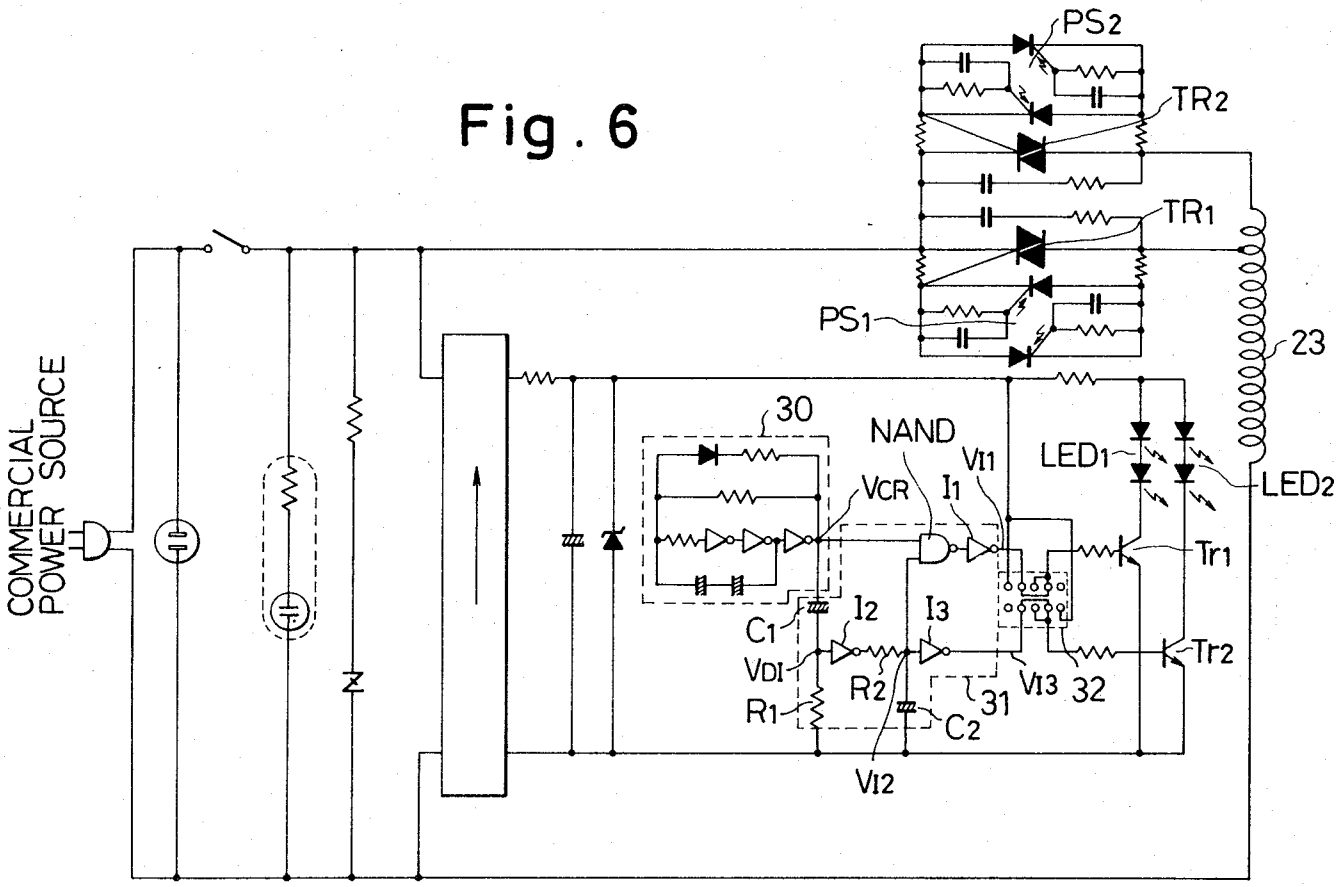
FIG. 6 is a circuit diagram in an embodiment of a motor control circuit used in the apparatus according to the present invention.
Figures 8A, 8B, 8C:
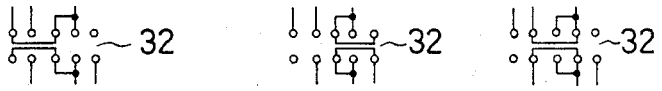
Figure 10:
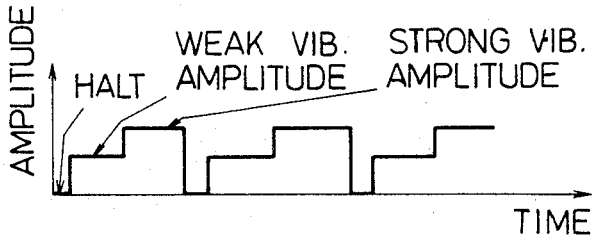
Figure 9:
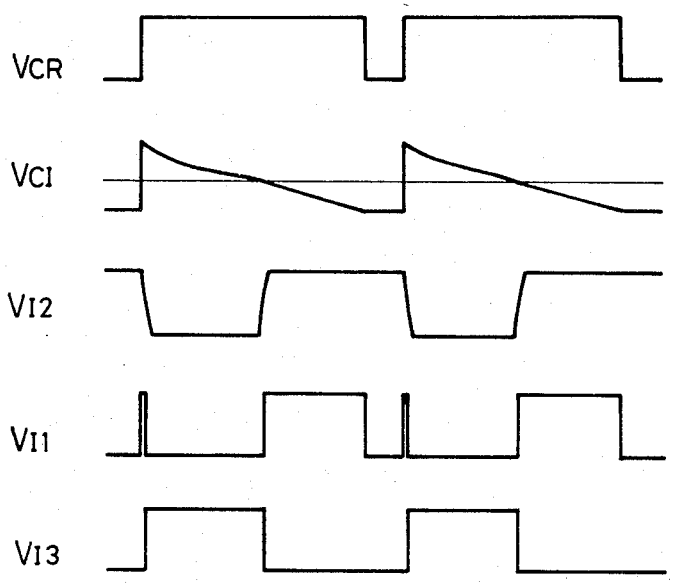
Figure 11:
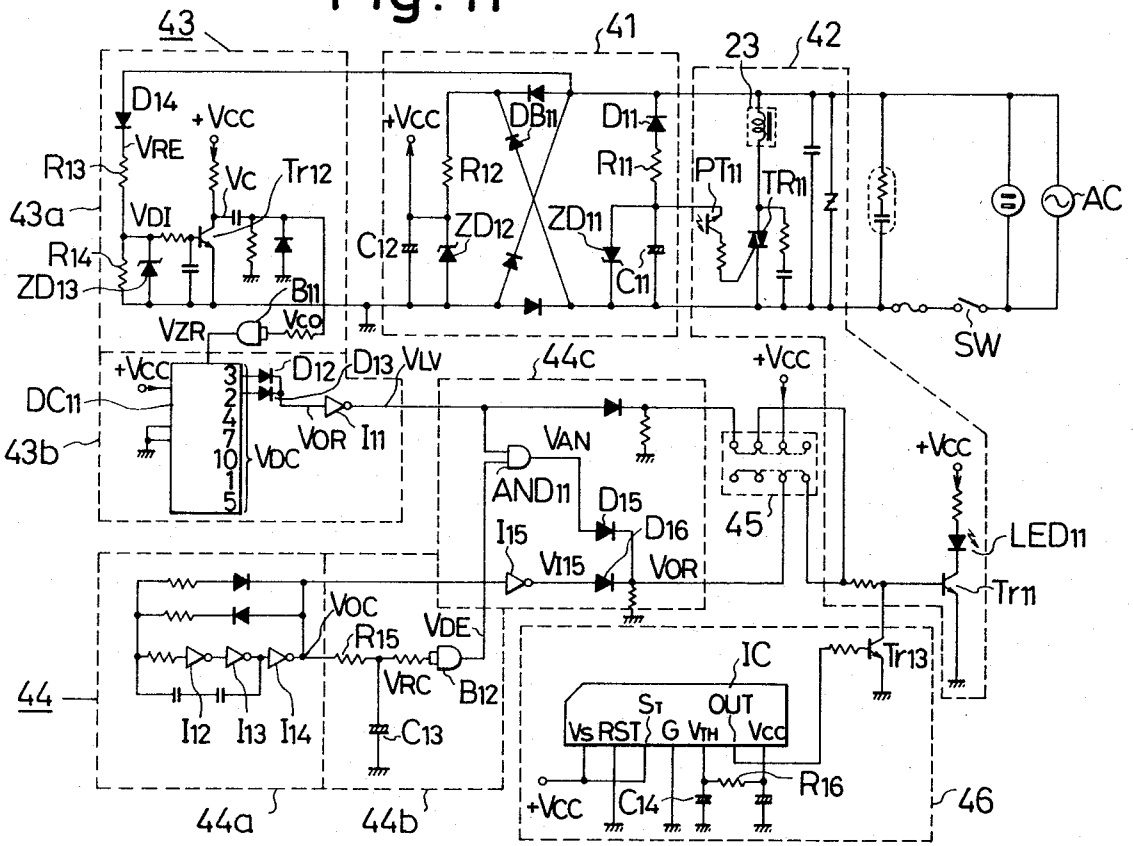
Figure 12:
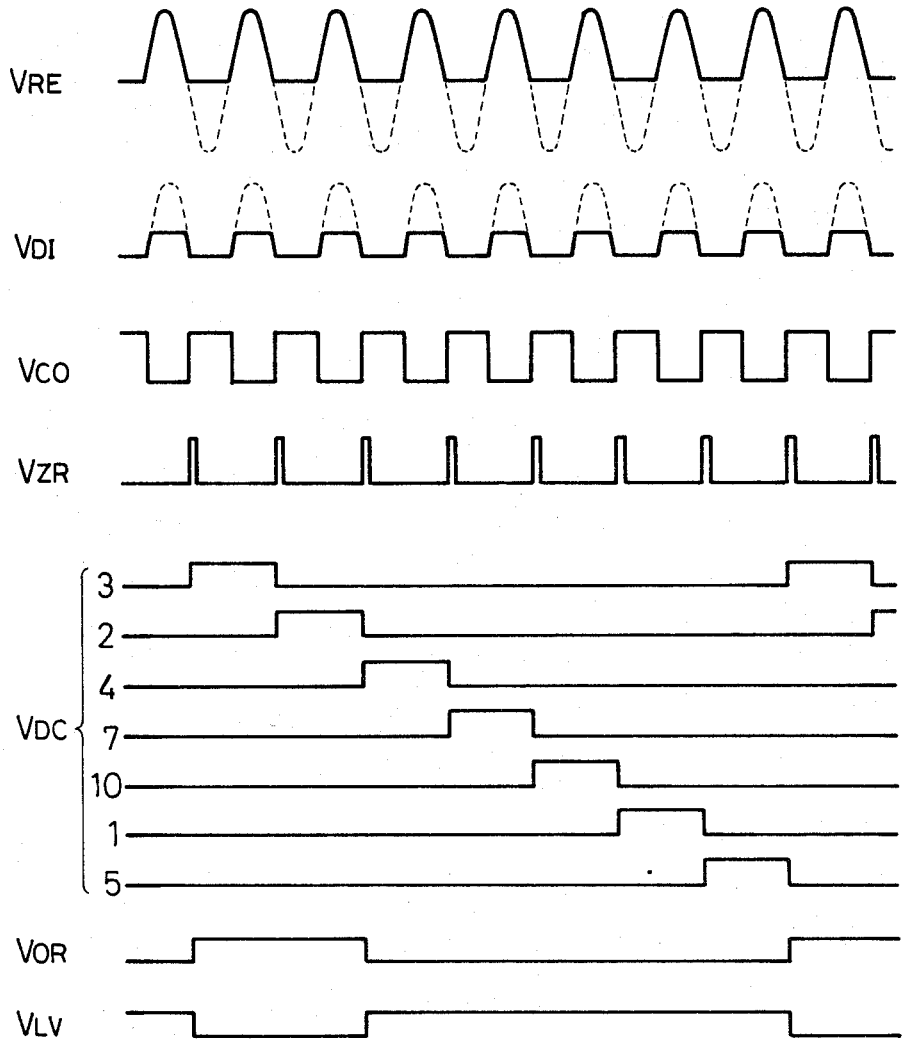
Figure 13:
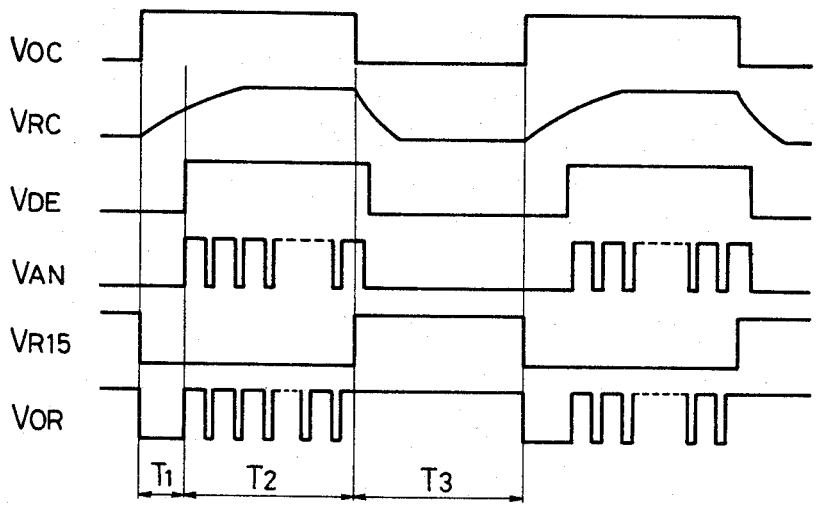
Figure 14:
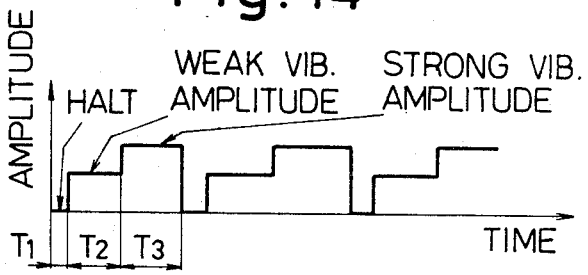
Figure 15:
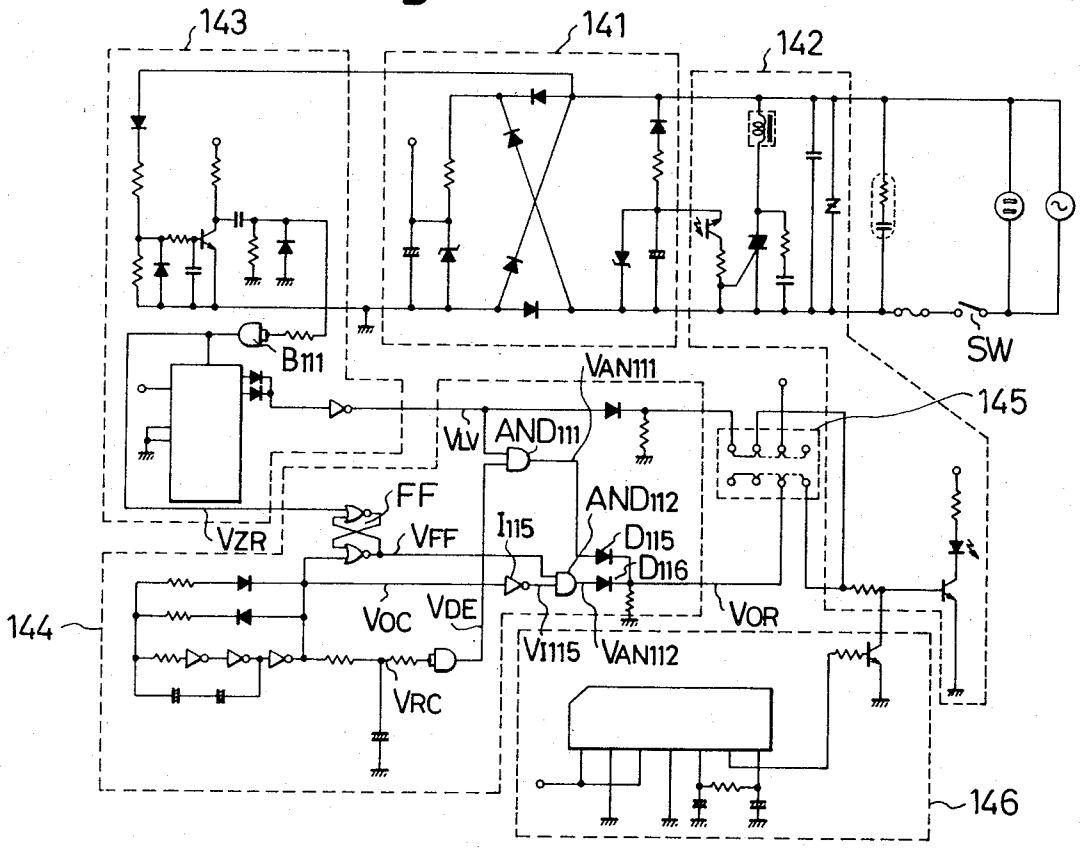
Figure 16:
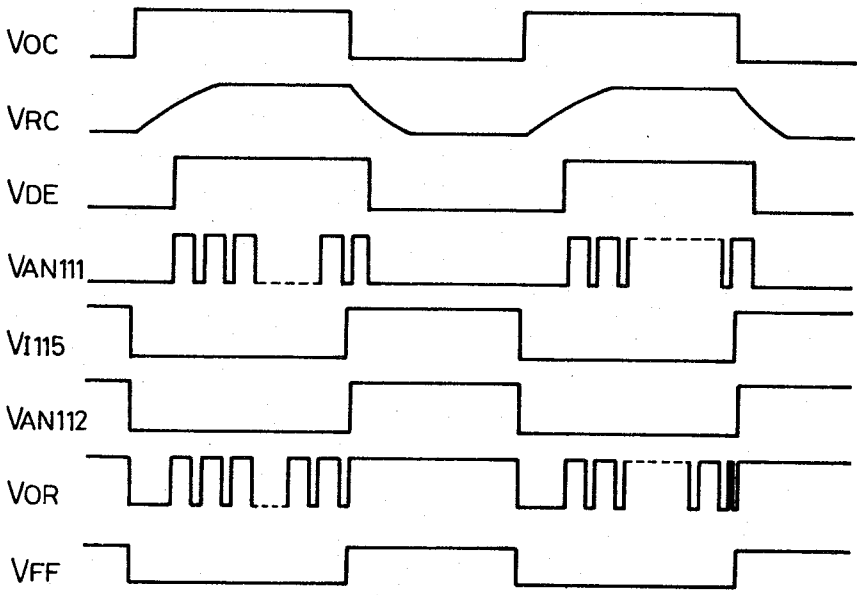

FIGS. 8*a*, 8*b*, 8*c* are explanatory views showing different switched positions of a change-over switch in the control circuit of FIG. 6;

FIG. 9 shows waveforms of output signals appearing at various points in a logic circuit in the control circuit of FIG. 6;

FIG. 10 shows diagramatically variations in the amplitude of vibration with respect to time;

FIG. 11 is a circuit diagram of another embodiment of the motor control circuit applicable to the apparatus according to the invention;

FIGS. 12 and 13 are waveforms of output signals appearing at various portions in the control circuit of FIG. 11;

FIG. 14 shows variations in the amplitude of vibration with respect to time in the embodiment of FIG. 11;

FIG. 15 is a circuit diagram of still another embodiment of the control circuit according to the invention; and FIG. 16 shows waveforms of output signals appearing at various portions in the control circuit of FIG. 15.

While the present invention shall be described with reference to the embodiments shown in the accompanying drawings, it should be understood that the invention is not limited only to the particular embodiments, but rather includes all other possible modifications, alterations and equivalent arrangements within the scope of appended claims.

Figure 1:
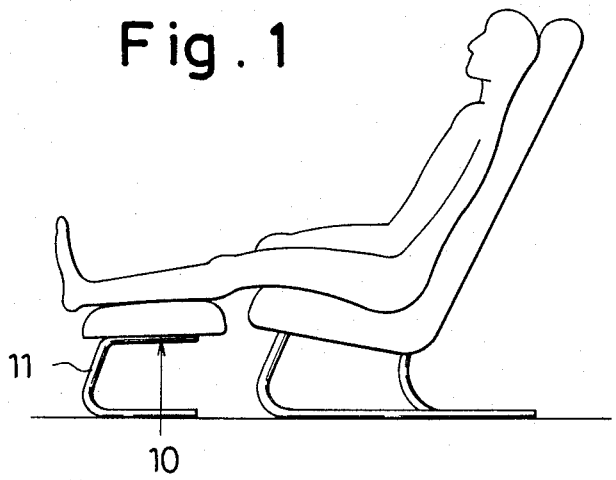
FIG. 1 is a schematic explanatory view showing a general usage of the vibratory massage apparatus.
Figure 2:
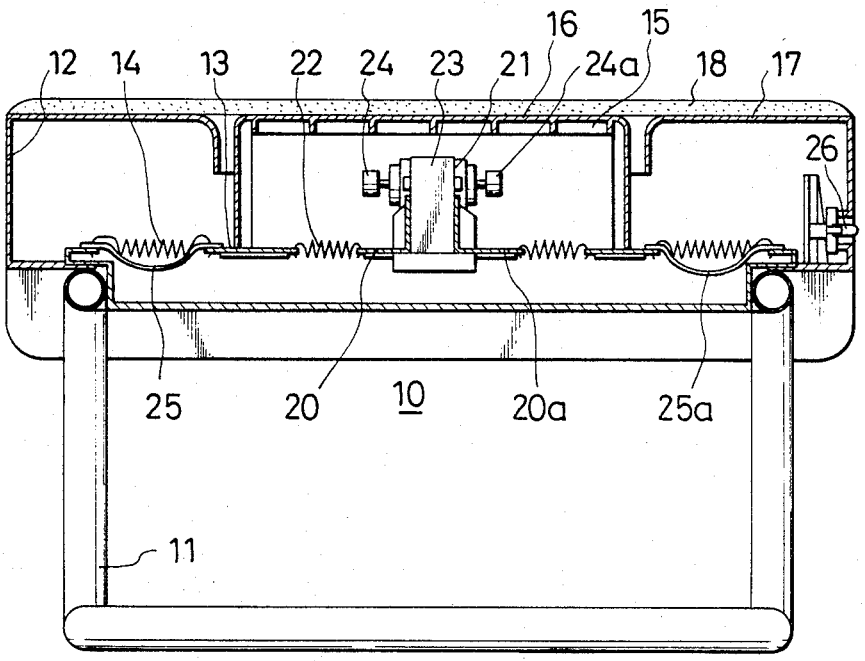
FIG. 2 is a sectional view of a vibratory massage apparatus in accordance with the present invention.
Figure 3:
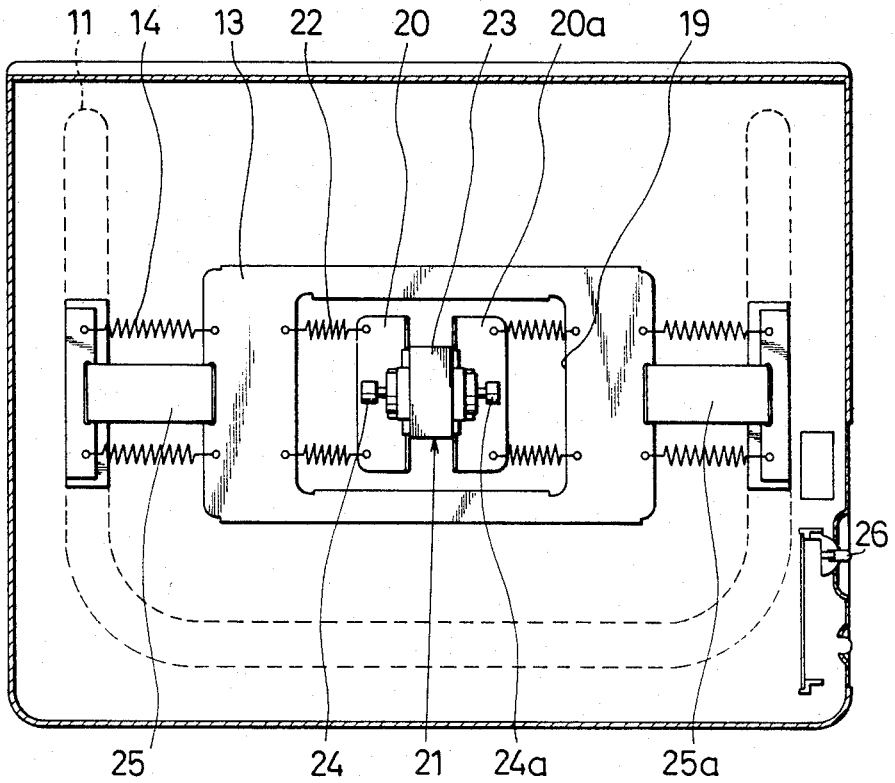
FIG. 3 is a plan view, partly in section, of the apparatus of FIG. 2.

Referring first to FIGS. 1 to 3, a supporting frame 10 made of a pipe member substantially U-shaped as viewed sidewise includes legs 11 providing elasticity, and a frame member 12 is mounted on these legs 11. Disposed substantiantially in the center of the frame member 12 is a first vibratory plate 13 which is engaged to one end of each of a first group of coil springs 14 (four in the illustrated embodiment) which are engaged at the other end to the frame member 12, whereby the plate 13 is supported to be vibratable relative to the frame member. Further, a treatment portion 15 which extends upward from the first vibratory plate 13 and has the upper flat face 16 is fixedly secured to the plate 13 so that the upper face 16 will be substantially flush with the upper face 17 of the frame member 12. A cushioning material 18 having a suitable covering is applied over the both upper faces 16 and 17 of the treatment portion 15 and frame member 12.

In an aperture 19 formed in the first vibratory plate 13, there are disposed centrally a pair of mutually opposing second vibratory plates 20 and 20*a* and a vibration generator 21 is secured as held between them. The second plates 20 and 20*a* are engaged to one end of each of a second group of coil springs 22 (four in the illustrated embodiment) which are engaged at their other ends to the first plate 13, whereby the second plates 20, 20*a* and vibration generator 21 are supported to be vibratable relative to the first plate 13. On the other hand, the vibration generator 21 comprises a shading-coil induction motor 23 and eccentric pendula 24 and 24*a* attached to an output shaft of the motor 23.

Further, protective belts 25 and 25*a* are hung between the frame member 12 and the first vibratory plate 13 as normally kept in a saggy state so as to be responsive to any excessive load applied to the first plate 13. In addition, a switch 26 for controlling the motor 23 is attached to one side portion of the frame member 12.

Figure 4:
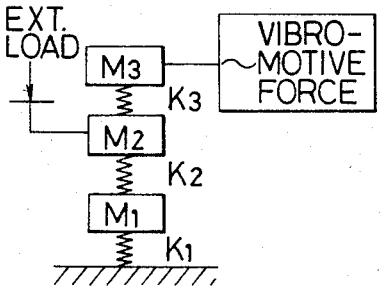
FIG. 4 is a diagram showing in an equivalent model a vibration system of the apparatus shown in FIG. 2.
Figure 5:
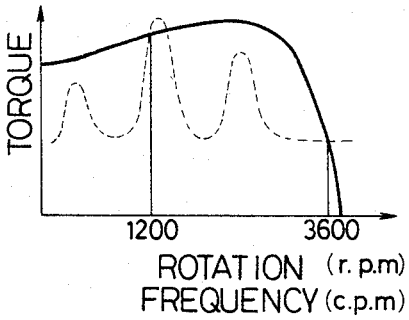
FIG. 5 is a characteristic diagram jointly showing relationships between torque and rotation of a motor and between load torque and frequency in the vibration system.

With the vibratory massage apparatus of the arrangement described above the user places, for example, his calf parts of legs on the treatment portion 15 as specifically shown in FIG. 1 and operates the switch 26 to drive the vibration generator 21 including the induction motor 23, whereby vibration generated by the generator 21 is transmitted to the treatment portion 15 through the second vibratory plates 20 and 20*a*, second group coil springs 22 and first vibratory plate 13, thus providing a massaging vibration to the user's calves. Assuming that, in this case, the frame member 12 has a weight of $M_1$, the first vibratory plate 13 and treatment portion 15 have a total weight of $M_2$ and the second vibratory plates 20, 20*a* and vibration generator 21 have a total weight of $M_3$ while the spring constants of the leg 11, first group coil springs 14 and second group coil springs 22 are $K_1$, $K_2$ and $K_3$, respectively, the vibration system of the massage apparatus may be illustrated in such equivalent model as shown in FIG. 4. That is, this vibration system has three degrees of freedom and, therefore, three natural frequencies as will be clear from the drawing. On the other hand, in the case where the motor 23 of the vibration generator 21 has such torque-to-rotation characteristic as shown by a solid line in FIG. 5 and if the vibromotive force caused by the generator 21 is balanced with the load of the vibration system, the vibration system will be in the state of resonance at any one of the three natural frequencies. Further, if the load-torque-to-frequency characteristic of the vibration system is such as shown by a dotted line in FIG. 3 and the rotation of the motor 23 is 3600 r.p.m., then the vibration of the generator will be of a frequency of 1100 to 1200 c.p.m., achieving thus a relatively large amplitude vibration.

In order to have the vibration system vibrated in the state of resonance at one of the natural frequencies under the foregoing condition, it may suffice the purpose, as will be easily appreciated by those skilled in the art, that the weights $M_1$, $M_2$ and $M_3$ and spring constants $K_1$, $K_2$ and $K_3$ of the respective members in the vibration system having the three degrees of freedom are properly selected to determine the natural frequencies, the torque characteristic curve of the motor 23 is selected to balance the torque of the motor 23 with the load-torque of the vibration system and the eccentric pendula 24 and 24*a* in the vibration generator 21 are properly adjusted. Further, when the user's affected part such as the legs is placed on the treatment portion 15, the weight $M_2$ (refer to FIG. 4) in the vibration system is varied to cause also the natural frequency to be varied. However, since the treatment portion 15 is mounted on the first vibratory plate 13 and the second group coil springs 22 are provided between the first plate 13 and the second vibratory plates 20 and 20*a* carrying the vibration generator 21, the resonant state of the vibration system will not be affected by the variation in the weight $M_2$.

Figure 7:
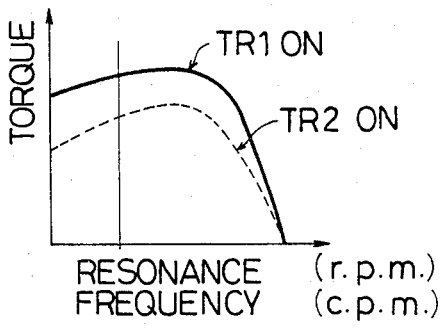
FIG. 7 is a characteristic diagram showing a relationship of the torque to the rotation and frequency in two different states of the motor used in the control circuit of FIG. 6.

Referring next in detail to a control circuit of the induction motor 23 in the vibration generator 21 with reference to FIG. 6, the motor winding is connected at its different positions with each of TRIACs $TR_1$ and $TR_2$ (three-terminal bidirectional thyristors.) In this case, the impedance becomes larger at the time when the TRIAC $TR_2$ is conducted than that of the TRIAC $TR_1$ connected to an intermediate tap of the motor winding, and the motor torque upon conduction of the TRIAC $TR_2$ becomes smaller as shown by a dotted line in FIG. 7 than that shown by a solid line in FIG. 7 upon conduction of the TRIAC $TR_1$. Even when the vibromotive force of the generator 21 is thus varied, on the other hand, the vibration system continues to vibrate at its own and substantially the same natural frequency as described above but the amplitude of the vibration is caused to be varied in response to the variations in the motor torque.

The control circuit further includes photo-thyristors $PS_1$ and $PS_2$ which receive outputs of light emitting diodes $LED_1$ and $LED_2$ and directly control the conduction of the TRIACs $TR_1$ and $TR_2$. In order to selectively drive the diodes $LED_1$ and $LED_2$, the control circuit further comprises a CR oscillator circuit 30, a logical operation circuit 31 connected to the oscillator 30 and having a delay circuit, transistors $Tr_1$ and $Tr_2$ connected respectively to the light emitting diodes, and a change-over switch 32 connected with the logical circuit 31 and transistors $Tr_1$ and $Tr_2$.

Referring now to the operation of the control circuit, the change-over switch 32 is set at its "strong" amplitude vibration mode position as shown in FIG. 8(*a*), then the transistor $Tr_1$ connected to the light emitting diode $LED_1$ only is turned ON regardless of the output level of the logic circuit 31 so that the TRIAC $TR_1$ is made conductive state through the diode $LED_1$ and the vibration generator 21 is driven, whereby the vibration system provides a large amplitude vibration. When the change-over switch 32 is set at its "weak" vibratory mode position as shown in FIG. 8(*b*), the transistor $Tr_2$ connected to the diode $LED_2$ only is similarly turned ON regardless of the output level of the logic circuit 31 so that the TRIAC $TR_2$ is made conductive through the diode $LED_2$ and the vibration generator 21 is driven, whereby the system provides a small amplitude vibration.

Next, when the change-over switch 32 is set at its "automatic" vibration mode position as shown in FIG. 8(*c*), two outputs of the logic circuit 31 are connected respectively to each of the transistors $Tr_1$ and $Tr_2$ through the switch 32. As will be clear in view of FIG. 6, more specifically, the logic circuit comprises a NAND circuit NAND, inverters $I_1$, $I_2$ and $I_3$, capacitors $C_1$and $C_2$, and resistors $R_1$ and $R_2$. Referring also to FIG. 9, if the CR oscillator circuit 30 generates an "L" level signal, i.e., if the circuit NAND receives an "L" level signal $V_{CR}$at one input terminal, then the inverters $I_1$ and $I_2$have both low level output signals $V_{I1}$ and $V_{I2}$, respectively, so that the transistors $Tr_1$ and $Tr_2$ are both turned OFF and the vibration generator 21 is not driven, whereby the system is put in a vibration halt period.

When the output of the CR oscillator circuit 30 becomes "H" level, an input signal $V_{DI}$ to the inverter $I_2$ will be "H" level for a fixed time (preferably about 20 sec.) determined by a differentiating circuit comprising the capacitor $C_1$ and resistor $R_1$. Since the other input to the circuit NAND and an input to the inverter $I_3$ are of "L" level, the output $V_{I1}$ of the inverter $I_1$will be "L" level, whereas the output $V_{I3}$ of the inverter $I_3$ will be "H" level. As a result, only the transistor $Tr_2$ is turned ON and the TRIAC $TR_2$ is conducted, whereby the vibration generator 21 is driven in the "weak" amplitude vibration mode. After the fixed time, the input $V_{DI}$ of the inverter $I_2$ becomes "L" level, then the other input to the circuit NAND and the input to the inverter $I_3$ will be "H" level, whereby the output $V_{I1}$ of the inverter $I_1$is made to be "H" level and the output $V_{I3}$ of the inverter $I_3$ is made "L" level. As a result, only the transistor $Tr_1$ is turned ON and the TRIAC $TR_1$ is conducted, whereby the vibration generator 21 is driven in the "strong" amplitude vibration mode.

In other words, when the change-over switch 32 is set at the "automatic" vibration mode position, the short vibration "halt" period, "weak" amplitude vibration period and "strong" amplitude vibration period are sequentially repeated, as will be clear from FIG. 10. When the system shifts from the "half" period to the "weak" amplitude period, an integration circuit of the resistor $R_2$ and capacitor $C_2$ functions to instantaneously turn the transistor $Tr_1$ ON so that, even if the motor 23 has a small starting torque, the motor 23 can smoothly start. More specifically, the moment at which the input $V_{I2}$ to the inverter $I_3$ becomes "L" level is delayed and, immediately after the shift of the output of the CR oscillation circuit to "H" level, the inverter output $V_{I1}$ becomes "H" level instantaneously to turn the transistor $Tr_1$ ON. While, at this time, the output of the logic circuit 31 will be momentarily in the state of causing the vibration generator 21 to perform the "strong" amplitude vibration, such state is practically of a very short period and thus the motor 23 is smoothly started and the generator 21 will not perform the "strong" amplitude vibration.

When the output $V_{CR}$ of the CR oscillation circuit 30 becomes again "L" level, the system is put again in the vibration "halt" period for a short time (preferably about 3 sec.) until the output of the CR oscillation circuit 30 becomes "H" level in the same manner as has been described.

Referring next to FIG. 11, there is shown another embodiment of the control circuit for the induction motor according to the present invention. The control circuit comprises a power supply circuit 41, a motor driver circuit 42, a circuit 43 for generating a "weak" amplitude vibration mode signal, a circuit 44 for generating an "automatic" vibration mode signal, a change-over switch 45 for mode setting, and a time circuit 46 for setting the operating time of the vibration generator. With this control circuit, the vibration generator 21 can be operated in the "strong"amplitude vibration mode with a continuous power supply to the generator, whereas an intermittent power supply causes the generator to be operated in the "weak" amplitude vibration mode.

More particulary, the power supply circuit 41 is arranged so as to obtain two constant voltages. That is, a voltage from a commercial power source AC is half-wave rectified by a diode $D_{11}$ and is made to be a constant voltage by means of a resistor $R_{11}$, Zener diode $ZD_{11}$ and capacitor $C_{11}$ to use it as a TRIAC driving source power, whereas the AC source voltage is full-wave rectified by a diode bridge $DB_{11}$ and is made to be another constant voltage by means of a resistor $R_{12}$, Zener diode $ZD_{12}$ and capacitor $C_{12}$ to use it as a circuit driving source voltage $V_{cc}$. On the other hand, the motor driver circuit 42 comprises a TRIAC $TR_{11}$ for controlling the energization of the motor 23, a phototransistor $PT_{11}$ for conducting thc TRIAC $TR_{11}$, a light emitting diode $LED_{11}$ optically coupled to the phototransistor $PT_{11}$, and a transistor $Tr_{11}$ for driving the diode $LED_{11}$. Therefore, a provision of "H" level input to the base of the transistor $Tr_{11}$turns this transistor $Tr_{11}$ to be ON so that the diode $LED_{11}$ emits light and thereby the phototransistor $PT_{11}$ is turned ON to have the TRIAC $TR_{11}$ conducted. As a result, the motor 23 is energized and the vibration generator 21 (see FIGS. 1 to 3) is driven.

The "weak" amplitude vibration signal generating circuit 43 comprises a zero-cross pulse generating circuit 43*a* and a signal forming circuit 43*b*, the latter of which includes a decade counter $DC_{11}$ for counting zero-cross pulses $V_{ZR}$ provided from the zero-cross signal generator 43*a*, diodes $D_{12}$ and $D_{13}$ and an inverter $I_{11}$. Referring also to FIG. 12 in conjunction with FIG. 11, in the zero-cross signal generator 43*a* of the illustrated arrangement, a voltage $V_{DI}$ obtained as the AC source voltage is half-wave rectified by a diode $D_{14}$ and a resultant voltage $V_{RE}$ is divided by resistors $R_{13}$ and $R_{14}$, is provided as an input to the base of a transistor $Tr_{12}$. This transistor $Tr_{12}$ is turned ON in the vicinity of a zero-cross point of the AC source voltage, a differential signal $V_{CO}$ of a collector voltage $V_C$ of the transistor $Tr_{12}$ is provided to a buffer circuit $B_{11}$, and a zero-cross pulse $V_{ZR}$ substantially synchronized with the zero-cross point of the AC source voltage is provided out of the buffer $B_{11}$. As a Zener diode $ZD_{13}$ is connected in parallel to the voltage dividing resistor $R_{14}$ to render the divided voltage $V_{DI}$ provided to the base of the transistor $Tr_{12}$ to be an abruptly rising voltage, any delay between the zero-cross point of the AC source voltage and a rising point of the zero-cross pulse $V_{ZR}$ can be made small, whereby such an action that will be explained in the following can be achieved.

In the signal forming circuit 43*b*, respective outputs $V_{CD}$ of the decade counter $DC_{11}$ are operated in an OR circuit of the diodes $D_{12}$ and $D_{13}$ and inverted by the inverter $I_{11}$, and there can be generated a "weak" amplitude vibration mode signal $V_{LV}$ having five cycles of high level periods (that is, motor energizing period) and two cycles of low level periods (that is, motor non-energizing period) in seven cycle duration of the commerical AC source voltage. In this case, as the delay of the rising point of the zero-cross pulse $V_{ZR}$ with respect to the zero-cross point of the AC source voltage is made small as has been referred to, the generation of the "weak" vibration mode signal $V_{LV}$in synchronism with the zero-cross pulse $V_{ZR}$, makes it possible to perform the ON and OFF operations of the motor 23 for its intermittent driving always in the vicinity of the zero-cross points so that any noise due to a rush current and the like can be minimized. In FIG. 12, the references $V_{DC}$ and $V_{OR}$ represent waveforms of output signals appearing at output terminals of the decade counter $DC_{11}$ and a waveform of the output signal from the OR circuit of the diodes $D_{12}$ and $D_{13}$, respectively.

The "automatic" mode signal generating circuit 44 comprises an oscillation circuit 44*a* including inverters $I_{12}$ through $I_{14}$, a delay circuit 44*b* including a resistor $R_{15}$, capacitor $C_{13}$ and buffer circuit $B_{12}$, and a signal synthesizing circuit 44*c* including an AND circuit $AND_{11}$, inverter $I_{15}$ and diodes $D_{15}$ and $D_{16}$. Referring to FIG.13 in conjunction with FIG. 11, and oscillation output $V_{OC}$ from the oscillation circuit 44*a* is inverted by the inverter $I_{15}$ and delayed by the delay circuit 44*b* to provide a signal $V_{RC}$ which is provided to the buffer circuit $B_{12}$, and such a delay signal as $V_{DE}$ is obtained from the buffer circuit $B_{12}$. This delay signal $V_{DE}$ as well as the foregoing "weak" vibration mode signal $V_{LV}$ are operated in the AND circuit $AND_{11}$ of the signal synthesizing circuit 44*c* to obtain an output signal $V_{AN}$, an output $V_{I15}$ of the inverter $I_{15}$ and output $V_{AN}$ of the AND circuit $AND_{11}$ are sent respectively to the diodes $D_{16}$ and $D_{15}$ to be subjected to a logical sum, and the signal synthesizing circuit 44*c* generates the "automatic" operation mode signal $V_{OR}$. In FIG. 13, respective time periods $T_1$, $T_2$ and $T_3$ in the "automatic" operation mode signal $V_{OR}$ correspond to the vibration "halt" period in which the signal $V_{OR}$ is at "L" level to stop the motor, the "weak" amplitude vibration period in which the signal $V_{OR}$ reaches intermittently "H" level to intermittently energized the motor, and the "strong" amplitude vibration period in which the signal $V_{OR}$ is always at "H" level to continuously energized the motor, respectively. In the control circuit of FIG. 11, further, the mode switching operation of the "automatic" operation mode signal generating circuit 44 can be achieved only with a simple circuit arrangement of the single oscillator 44*a* and delay circuit 44*b*, so that any timing fluctuation in the mode switching operations can be remarkably minimized.

In addition, when the mode change-over switch 45 is shifted to the left side position in FIG. 11, the "weak" vibration mode signal $V_{LV}$ is provided to the base of the transistor $Tr_{11}$, the motor is driven during the five cycles among seven of the commercial AC source voltage and is halted during the remaining two cycles, and the motor is intermittently driven, as has been described. As a result, the average drive torque of the motor is decreased, and the vibration generator is driven with a relatively small vibration amplitude. When the switch 45 is positioned in the middle in FIG. 11, next, the "strong" vibration mode signal, i.e., the circuit voltage $V_{CC}$ of "H" level is applied substantially as it is to the base of the transistor $Tr_{11}$ and the motor is continuously operated to drive the vibration generator with a relatively large vibration amplitude. When the change-over switch 45 is shifted to the right side position in FIG. 11, the "automatic" mode signal $V_{OR}$ is applied to the base of the transistor $Tr_{11}$ as has been described and the sequential repetition of the vibration "halt" and "weak" and "strong"amplitude vibration periods $T_1$, $T_2$ and $T_3$ is automatically performed. In this case, the periods $T_1$, $T_2$ and $T_3$ are selected preferably to be 3, 20 and 20 sec., respectively (refer to FIG. 14.)

The timer circuit 46 comprises a transistor $Tr_{13}$ and an IC circuit which includes a clock generator for generating clock signals of which frequency is determined by a resistor $R_{16}$ and capacitor $C_{14}$ and a counter for counting the clocks. After a predetermined time from an application of the circuit voltage $V_{CC}$ to the IC circuit, the transistor $Tr_{13}$ in the motor driver circuit 42 is turned ON so that the base voltage of the transistor $Tr_{11}$ in the driver circuit 42 is forced to be at "L" level and thus to be turned OFF. As a result, it can be prevented that the apparatus continues to operate unnecessarily beyond the predetermined time, even when, for example, the apparatus is operated in the "automatic" operation mode and the user happens to forget to turn off the power source switch SW. Further, the timer 46 is provided to be reset upon the turn-off operation of the power switch SW.

There is shown in FIG. 15 another embodiment of the motor control circuit according to the present invention, wherein the same elements as those in the control circuit of FIG. 11 are denoted by the same reference numerals but as added by 100. In this embodiment, the "automatic" mode signal generating circuit 144 further comprises an R-S flip-flop circuit FF and an AND circuit $AND_{112}$. Referring also to FIG. 16, an output of the buffer circuit $B_{111}$ in the "weak" vibration mode signal generating circuit 143, i.e., the zero-cross pulse $V_{ZR}$ is provided to the flip-flop FF, and an output $V_{FF}$ of the flip-flop FF is provided to one of input terminals of the AND circuit $AND_{112}$, to the other input terminal of which the output $V_{I115}$ of the inverter $I_{115}$ is provided, and an output $V_{AN112}$ of the circuit $AND_{112}$ is provided to the diode $D_{116}$ as an input to the OR circuit of the diodes $D_{115}$ and $D_{116}$ to provide from the OR circuit the output signal $V_{OR}$, whereby, as will be clear from FIG. 16, the shifting timing from the "weak" amplitude vibration mode to the "strong" amplitude vibration mode can be effectively synchronized with the zero-cross pulse $V_{ZR}$, so that any noise generation upon the mode change-over can be prevented.

Other arrangements and operation of the embodiment of FIG. 15 are substantially the same as those in the embodiment of FIG. 11.

According to the present invention of the arrangement disclose in the foregoing, the vibration amplitude of the vibration generator can be effectively varied and, consequently, the massaging treatment with respect to the user's affected part by means of the treatment portion can be properly adjusted to be weak and strong, and the user's habituation to the vibratory stimulation can be well prevented. Accordingly, it can be expected that an effective massaging effect is achieved over a long time of use so that the user'affected part can be properly and sufficiently treated.

What is claimed as our invention is:

1. A vibratory massage apparatus comprising a support means;

treating means eleastically supported on said support means for treating the user's affected body part;

vibration generating means held on the support means and including a motor for generating a vibratory motion which is transmitted to said treating means;

a vibratory plate carrying said treating means;

first spring means elastically coupling said vibratory plate to said support means;

second spring means elastically coupling said vibration generating means to said vibratory plate;

said vibratory plate, said vibration generating means and said first and second spring means defining a vibration system in which said vibratory plate is vibrated at a frequency close to a natural frequency of said vibration system; and a controlling means electrically connected to said motor for controlling said vibratory motion by cyclically varying its vibration amplitude;

said controlling means including a first means for actuating said motor to produce a vibratory motion at a relatively smaller amplitude, a second means for actuating said motor to produce vibratory motion at a relatively larger amplitude, and means for actuating said first and second means immediately succeedingly and for imposing a halt period of zero amplitude immediately following the actuation of said second means to produce cyclical vibratory pattern comprising immediately succeeding periods of smaller, larger and zero vibratory amplitudes.

* * * * *